US005690999A

United States Patent [19]

Rantanen

[11] Patent Number: 5,690,999

[45] Date of Patent: Nov. 25, 1997

[54] METHOD AND COATING DEVICE FOR THE COATING OF A SIZE-PRESS ROLL, PAPER OR BOARD

[75] Inventor: Rauno Rantanen, Muurame, Finland

[73] Assignee: Valmet Corporation, Helsinki, Finland

[21] Appl. No.: 944,064

[22] Filed: Sep. 11, 1992

[30] Foreign Application Priority Data

Sep. 16, 1991 [FI] Finland ..... 914327

[51] Int. Cl.[6] ..... B05D 3/12; B05D 1/28; B05C 1/12

[52] U.S. Cl. ..... 427/355; 427/356; 427/211; 427/428; 118/227; 118/262; 118/303

[58] Field of Search ..... 422/211, 428; 118/227, 262, 303; 427/355, 356

[56] References Cited

U.S. PATENT DOCUMENTS 2,676,563 4/1954 Montgomery et al. ..... 118/227
4,839,201 6/1989 Rantanen et al. ..... 427/355
4,981,726 1/1991 Rantanen ..... 427/356

*Primary Examiner*—Shrive Beck
*Assistant Examiner*—B Chen
*Attorney, Agent, or Firm*—Steinberg, Raskin & Davidson, P.C.

[57] ABSTRACT

The invention relates to a coating device for the coating of a size-press roll, paper or board or an equivalent moving base. The coating device includes a revolving coating bar which rests against a moving base. The coating bar extends across the machine width and is supported on a cradle substantially over its entire length. The coating bar spreads and smooths a coating agent introduced into the coating device and applied onto the moving base before the moving base contacts the coating bar. The coating bar in accordance with the invention is a smooth bar of large diameter, fitted against the moving base so that the profile of coating quantity of the coating agent can be controlled.

12 Claims, 3 Drawing Sheets

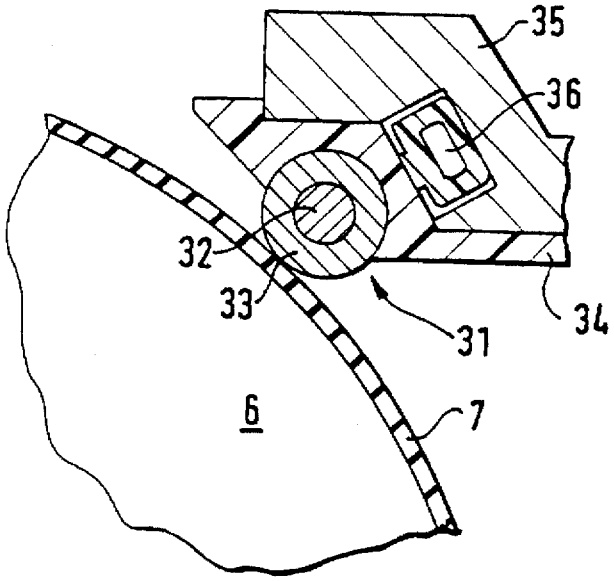
FIG. 2
FIG. 3
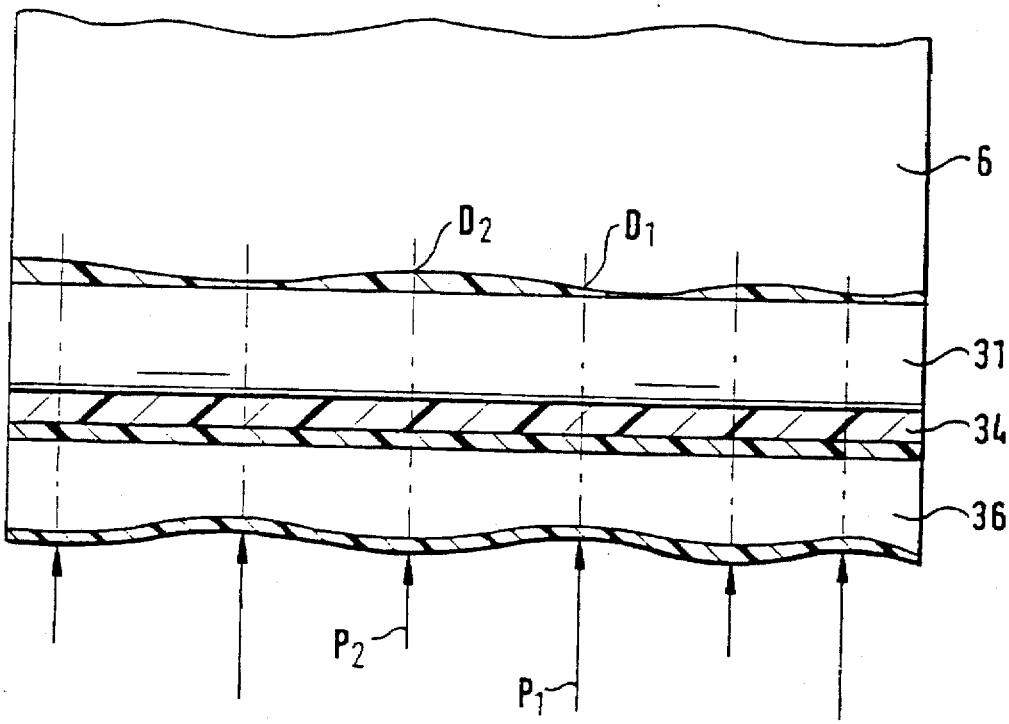

METHOD AND COATING DEVICE FOR THE COATING OF A SIZE-PRESS ROLL, PAPER OR BOARD

FIELD OF THE INVENTION

The invention concerns a method for coating a size-press roll, paper or board or an equivalent moving base. The coating device used in the method comprises a revolving coating bar which rests against the moving base and extends across the machine width. The coating bar is supported in a cradle substantially over its entire length and is fitted to spread and to smooth a coating agent onto the moving base. A coating agent is introduced into the coating device in the running direction of the moving base before the coating bar.

The invention is further related to a coating device for coating a size-press roll, paper or board or an equivalent moving base. The coating device comprises a revolving coating bar which rests against the moving base. The coating bar extends across the machine width and is supported substantially over its entire length on a cradle. The coating bar is also fitted to spread and smooth a coating agent onto the moving base. The coating agent has been introduced into the coating device in the running direction of the moving base before the coating bar.

BACKGROUND OF THE INVENTION

At present, in the coating of paper or board, two alternative methods and devices are commonly used, i.e. a blade coater or a bar coater. The present invention is expressly related to the latter, bar coaters, which have proved excellent especially in the film size press technique. The material of the coating bars currently in use is usually steel, and, in view of increasing the service life of the bar, the bars are provided with chromium plating. In surface sizing of paper, bars with fully smooth faces have not been used. Rather, the face of the coating bar has been provided with grooves, or alternatively steel wire is wound onto the bar to form a solution similar to grooves on the bar face. A grooved bar is used for the surface sizing of paper because the thickness of the size film to be applied onto the base to be coated is determined by means of the depth of the grooves.

A grooved bar is, however, poorly suitable for the preparation of thin size films, because it is very difficult to manufacture grooves of sufficiently small scale. On the other hand, such small grooves are easily contaminated. It is a further highly significant drawback of grooved bars that they are worn rapidly. Pigmenting with a high dry solids content is also entirely impossible with grooved bars, because the wear of the bars is excessive in this connection. The diameters of the coating bars currently in use have been very small. Small-diameter bars are used because the bar should be able to adapt itself to the shape of the roll face in the size press in order that the profile of the size film could be made suitable and correct. The order of magnitude of the diameter of currently used coating bars is preferably about 10 mm.

With respect to the prior art, reference is made in particular to the U.S. Pat. No. 2,097,564, from which a solution is known for spreading of a size film or of a pigment coating film onto the rolls in a size press, said films being transferred to the paper in the nip in the film size press. In the method described therein, smooth or grooved bars are used for the metering of the size film. It is stated therein that while it is possible to use a smooth-faced bar of small diameter (diameter about 9 mm) for surface sizing, such a bar is unsatisfactory. Accordingly, a corresponding solution has never been applied in practice.

In respect to the prior art, reference is further made to FI Patent No. 30,147 and to applicant's FI Patent Appl. No. 901967 of earlier date.

From applicant's FI Patent Appl. No. 901967, it is known to control the quantity of size and/or pigment coating in respect of the profiles by means of a large-diameter bar by using special constructions either in the bar itself or in the roll. The quantity can be controlled by using a special construction in the roll whose face is coated and from which the coating is transferred to the paper in the nip in the size press.

In this earlier patent application, it should be noted that the bar comprises a small-diameter body on which bushings have been fitted. The bushings are attached to one another in a suitable way as non-revolving. With regard to special constructions related to the roll, rolls are provided with coatings of particular cross-sectional shapes and, in addition, rolls in a size press in which each of the rolls in the nip is a variable-crown roll.

OBJECTS AND SUMMARY OF THE INVENTION

An object of the present invention is to provide a new and improved coating device which avoids the drawbacks of the prior art and by whose means a significant improvement is produced in the pigmenting of paper. A further object is to provide an embodiment with increased technical efficiency over the prior art, notably FI Patent Appl. No. 901967.

In view of achieving the above object and others, in the method in the present invention, a loading pressure is applied against a revolving coating bar of a coating device in order to fit the coating bar against a moving base. The coating bar extends in a transverse direction across a width of the moving base and is supported substantially over its entire length by means of a cradle. A coating agent is applied from the coating device onto the moving base before the moving base comes into contact with the coating bar. After the coating agent is applied onto the moving base, the coating bar spreads and smooths the coating agent on the moving base. The loading pressure of the coating bar is regulated in the transverse direction so that the quantity of the coating agent applied onto the moving base is also regulated.

In a second embodiment of the method in the present invention, a coating device of the short-dwell type is used. A coating agent is introduced into a pressurized coating-agent chamber located in the coating device. The coating agent is then applied from the pressurized coating-agent chamber onto the moving base before the moving base comes into contact with the coating bar. A large-diameter smooth bar is fitted against the moving base and is used as the coating bar.

In the device in the present invention, a large-diameter smooth bar is used as a revolving coating bar. The revolving coating bar extends across a moving base in a transverse direction so that the revolving coating bar rests against the moving base. The revolving coating bar is supported by a cradle substantially across its length in the transverse direction. In the device, means are provided for applying a coating agent onto the moving base before the revolving coating bar in the running direction of the moving base. The revolving coating bar spreads and smooths the coating agent on the moving base. Regulating means are also provided to regulate the loading pressure of the revolving coating bar and coating quantity of the coating agent in the transverse direction.

It is an important advantage of the present invention that when using a large-diameter coating bar, it is now possible to run very thin size films and coating pastes of high dry solids content even at high running speeds. With the device in accordance with the invention, the level of the coating quantity and the profile of the coating have been very good. In factory test runs that have been carried out, it has been noted that the profiling can be carried out quite satisfactorily by using, for example, a bar whose diameter is about 35 mm and which comprises of a tube whose wall thickness is about 3 mm, by regulating the profile of loading pressure of the bar. Further advantages and characteristic features of the invention are apparent from the following detailed description of the invention.

BRIEF DESCRIPTION OF THE DRAWINGS

The following drawings are illustrative of embodiments of the invention and are not meant to limit the scope of the invention as encompassed by the claims.

FIG. 2 is a schematic sectional view of an alternative embodiment of a coating-bar construction in a coating device in accordance with the invention.

FIG. 3 is a schematic illustration of an application of the regulation of the profile of the coating bar.

DETAILED DESCRIPTION OF THE INVENTION

Figure 1:
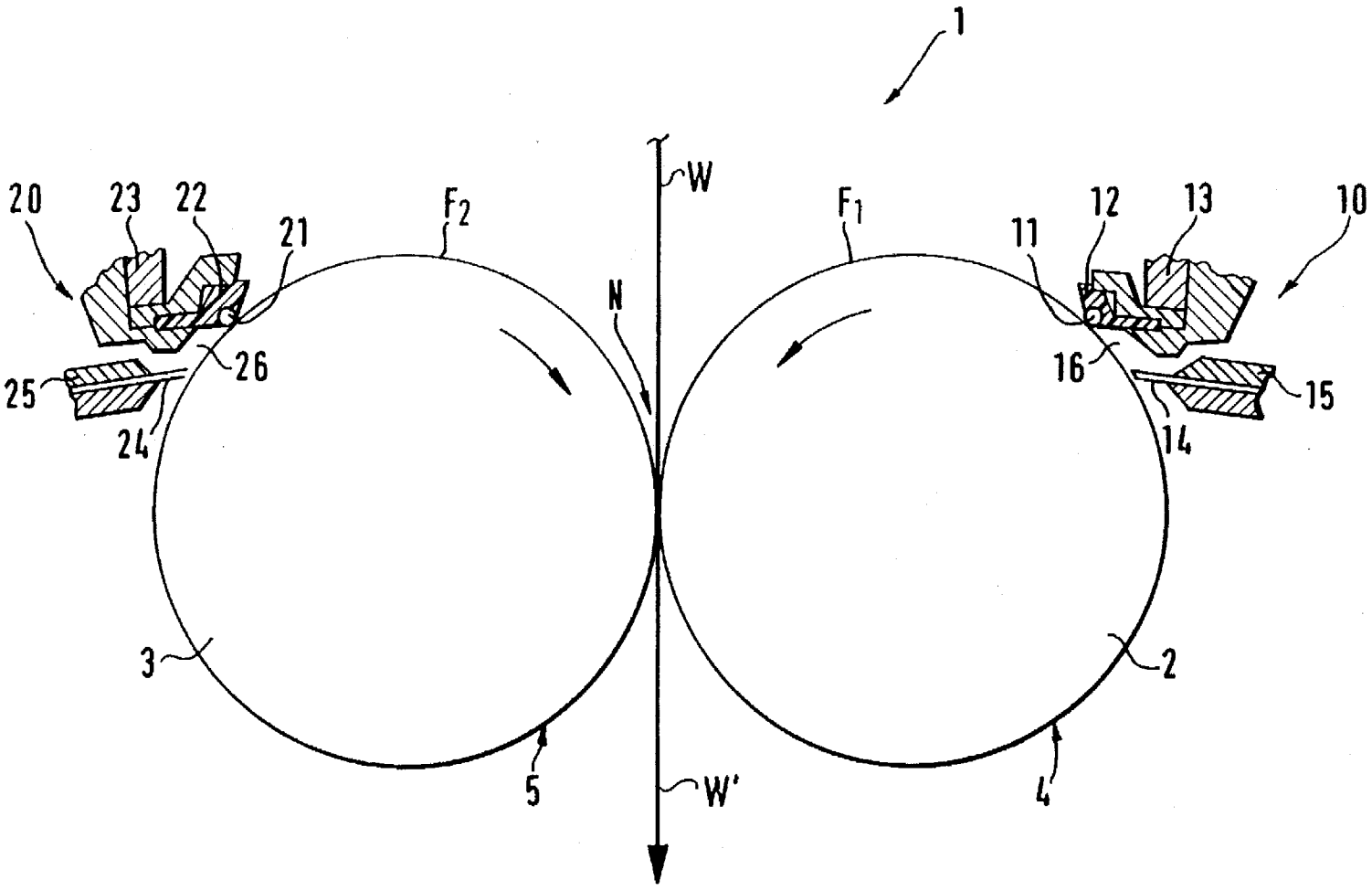
FIG. 1 is a fully schematic side view of a film size press in which a coating device in accordance with the invention is applied.

FIG. 1 is a schematic illustration of the size press, which is denoted generally with the reference numeral 1. The film size press 1 comprises size press rolls 2 and 3 so that the first roll 2 and the second roll 3 form a nip N between them, the paper or board web W being passed through said nip. In the film size press 1, a film size $F_1$ is metered onto the face 4 of the first roll by means of a first coating device 10 and, in a corresponding manner, a second size film $F_2$ is metered onto the face 5 of the second roll by means of a second coating device 20. In the roll nip N, the size films $F_1$ and $F_2$ are transferred onto the paper or board web W running through the nip. In FIG. 1, the coated web is denoted with the reference W'. Thus, the metering of size films $F_1$ and $F_2$ onto faces 4 and 5, respectively, constitutes a premetering step with respect to the metering of the size films $F_1$ and $F_2$ onto the board or paper web.

In the film size press 1 shown in FIG. 1, the coating devices 10 and 20, by whose means the size films $F_1$ and $F_2$ are spread onto the faces 4 and 5 of the rolls 2 and 3 in the size press, are bar coaters, which are substantially equal to one another, as is shown in FIG. 1. The coating devices 10 and 20 are coating devices of so-called short-dwell type, in which the coating agent is introduced into a pressurized coating-agent chamber 16, 26 placed before the coating bar 11, 21. Besides being defined by the coating bar 11, 21 and then applied without being metered onto the moving base the chamber is also defined by the roll face 4, 5, by the front wall 14, 24 of the coating-agent chamber, as well as by possible lateral seals, if any (not shown). The coating bar 11,21 is fitted in a cradle 12,22 made of a suitable material, for example polyurethane. The cradle 12,22 supports the coating bar 11,21 substantially over its entire length.

The coating bar 11,21 is provided with a purposeful drive gear (not shown), by whose means the coating bar 11,21 is rotated in directions opposite to the directions of rotation of the rolls 2,3. Further, in FIG. 1, the holders of the cradles of the coating bars are denoted with the reference numerals 13 and 23, and the holders of the front wall with the reference numerals 15 and 25, Between the coating bar 11,21, cradle 12,22 and the holder 13,23, an ordinary loading hose or equivalent (not shown) is fitted. By means of this loading hose, the coating bar 11,21 can be loaded against the roll face 4,5 to produce the desired loading pressure.

In accordance with the invention, in the coating devices 10, 20 shown in FIG. 1, a smooth-faced coating bar 11, 21 is employed. In addition to the fact that the coating bar 11, 21 in the present invention has a smooth face, the diameter of the coating bar 11, 21 is substantially larger than prior art coating bars. In the coating device in the present invention, the diameter of the coating bar 11, 21 is at least 18 mm, and, in test runs, very good results have been obtained with a coating device in which the diameter of the coating bar was about 35 mm.

In particular in wide machines, it is necessary to regulate the profile of the coating quantity produced in the coating device. In factory test runs it has been noticed that the prior art constructions with small-diameter coating bars, in which the coating quantity profile can be controlled by regulating the loading of the bar locally and the load profile is transferred to the coating process as the coating bar is deflected, are also used for profiling a rigid bar of a large diameter. This is why, for the device in accordance with the invention, alternative solutions have been developed for the purpose of regulating the loading profile.

FIG. 2 shows an alternative solution, by whose means the regulation of the profile of the coating quantity can be carried out by means of a large-diameter coating bar in accordance with the invention. In FIG. 2, the size press roll is denoted with the reference numeral 6. The roll 6 is provided with a coating 7 in a conventional manner in which coating 7 may be rubber or an equivalent. Furthermore, the coating bar is denoted with the reference numeral 31 and, in the embodiment shown in FIG. 2, the coating bar 31 comprises a small-diameter body 32. The body 32 of the bar is provided with a suitable outer layer 33, by whose means the diameter of the bar 31 can be made sufficiently large. The outer layer 33 may be formed, e.g., from a tube whose outer diameter is of an order of about 35 mm and the wall thickness about 3 mm.

On the other hand, the outer layer 33 may also consist of bushings fitted on the bar body 32, the bushings being attached to one another in a suitable way as non-revolving. In some cases, the bar 31 as a whole may be formed of a tube of the size mentioned above without a body part.

In a conventional manner, the bar 31 is installed as revolving in cradle 34 made, for example of polyurethane, which cradle 34 is attached to a cradle holder 35. Between the cradle holder 35 and the cradle 34, a loading hose 36 or an equivalent loading member is fitted by whose means the bar 31 can be loaded as desired against the roll 6. In the embodiments shown in FIG. 2, when a small-diameter bar body 32 is used, by means of the loading hose 36, the bar 31 can be profiled in a way corresponding to the prior art small-diameter bars.

FIG. 3 shows another embodiment of the invention which provides a manner for adjusting the profile of the coating quantity on the size press rolls to the correct level by means of coating bars in accordance with the invention. In FIG. 3, the backup roll is denoted by reference numeral 6. The backup roll may be for example a size press roll. Reference numeral 34 denotes a cradle for the coating bar, and reference numeral 36 represents a loading hose that loads the coating bar.

According to FIG. 3, the regulating of the profile is carried out by mechanically adjusting the degree of flatness of the loading hose 36 that loads the bar 31, as is illustrated in FIG. 3, by means of the arrows $P_1$ and $P_2$, which represent the forces that load the loading hose 36. The force $P_1$ is higher than $P_2$. At the point where the loading hose 36 is pressed more flat (force $P_1$), the loading linear pressure is higher, because the pressure in the loading hose 36 is applied to a larger area of the loading hose.

The profile of linear pressure produced by the bar 31 can also be regulated by means of other techniques, for example, by loading the bar 31 mechanically with different forces at different points. Such an embodiment differs from FIG. 3 in the respect that the forces $P_1$ and $P_2$ would act upon the cradle 34 of the bar directly, without a loading hose 36. The effect produced by the loading forces $P_1$ and $P_2$ on the profile of coating quantity is that, at the higher loading force $P_1$, the linear pressure is higher, whereby, correspondingly, at this point, the thickness $D_1$ of the coating layer is smaller. In a corresponding way, a lower loading force $P_2$ provides a thicker coating layer $D_2$.

Figure 4:
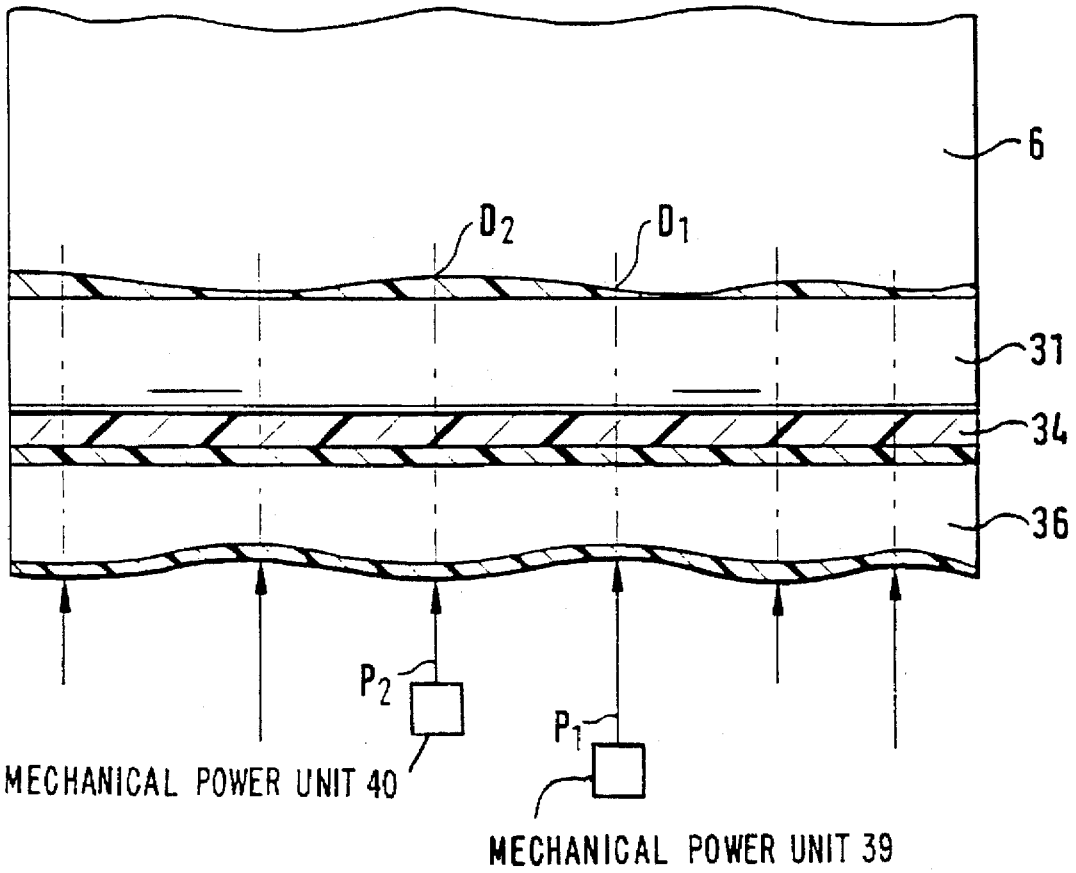
FIG. 4 is an additional schematic illustration of an application of the regulation of the profile of the coating bar.

As illustrated in FIG. 4, the forces $P_1$ and $P_2$ can be produced by mechanical power units 39, 40, respectively. In a preferred embodiment, by means of the mechanical power units, the coating bar 31 can be loaded with forces of different magnitudes at different points and also the extent of flatness of the loading hose 36 can be adjusted.

When used in the present invention, a coating bar 31 having a diameter of about 35 mm is quite rigid. Even minor changes in the deflection of the coating bar will have a clear effect on the coating quantity, because the thickness of the size of pigment coating is very little. Typically, the thickness of the coating layer is of an order of from about 4 μm to about 20 μm.

In a film size press, in which the size or pigment coating is spread by means of a coating bar 31 first onto a size press roll 6, and then only in the nip onto the paper, a good result in respect of the profiling can be achieved by using roll coatings whose hardness is about 30 P&J to about 40 P&J.

The examples provided above are not meant to be exclusive. Many other variations of the present invention would be obvious to those skilled in the art, and are contemplated to be within the scope of the appended claims.

What is claimed is:

1. A method for coating a size-press roll, paper, board or a surface of a moving object, comprising the steps of:

providing a coating bar having a diameter greater than about 18 mm and a smooth outer surface, supporting said coating bar in a cradle of a coating device substantially over its entire length, fitting said coating bar against a moving base, said coating bar extending in a transverse direction across a width of said moving base, applying a loading pressure against said revolving coating bar, introducing a coating agent into a pressurized coating-agent chamber in said coating device, said pressurized coating-agent chamber being defined at least in part by said coating bar, applying an unmetered amount of the coating agent from said pressurized coating-agent chamber onto said moving base in the running direction of said moving base before said coating bar, metering the coating agent on said moving base by regulating the loading pressure of said coating bar in the transverse direction to thereby regulate the quantity of the coating agent being applied onto said moving base, said metering step comprising the step of adjusting the degree of flatness of a loading hose in said coating device which provides the loading pressure of said coating bar.

2. A method as claimed in claim 1, further comprising loading said coating bar with forces of different magnitudes at different points in the transverse direction.

3. A method as claimed in claim 1, wherein the loading pressure of said coating bar is regulated by means of mechanical power units.

4. A method as claimed in claim 1, wherein said moving base comprises a roll having a coating whose hardness is from about 30 P&J to about 40 P&J.

5. A method as claimed in claim 1, wherein said coating bar has a diameter of about 35 mm.

6. A method as claimed in claim 1, wherein said moving base has a hardness of about 30 P & J to about 40 P & J.

7. A coating device for coating a size-press roll, paper, board or a surface of a moving object, comprising a moving base, a revolving coating bar extending across said moving base in a transverse direction, said revolving coating bar being loaded against said moving base, said revolving coating bar comprising a large-diameter smooth bar having a diameter of at least about 18 mm and a smooth outer surface, a cradle for supporting said revolving coating bar substantially across its length in said transverse direction, means for applying an unmetered amount of coating agent onto said moving base before said revolving coating bar in the running direction of the moving base, said means for applying a coating agent onto said moving base including a pressurized coating-agent chamber defined at least in part by said revolving coating bar, and metering means for metering the coating agent on said moving base by regulating the loading pressure of said revolving coating bar in said transverse direction to thereby regulate the quantity of the coating agent being applied onto said moving base, said metering means comprising a loading hose located in said coating device and arranged to load said coating bar, said metering means being structured and arranged to adjust the extent of flatness of said loading hose.

8. A coating device as claimed in claim 7, wherein said regulating means comprises mechanical power units structured and arranged to load said revolving coating bar with forces of different magnitudes at different points in said transverse direction.

9. A coating device as claimed in claim 7, wherein said loading hose is structured and arranged to be loaded in said transverse direction.

10. A coating device as claimed in claim 7, wherein said moving base is a press roll having a roll coating with a hardness of from about 30 P&J to about 40 P&J.

11. A coating device as claimed in claim 7, wherein said coating bar has a diameter of about 35 mm.

12. A coating device as claimed in claim 7, wherein said moving base has a hardness of about 30 P & J to about 40 P & J.

* * * * *